US011009291B2

(12) United States Patent
Christensen et al.

(10) Patent No.: US 11,009,291 B2
(45) Date of Patent: May 18, 2021

(54) METHOD FOR AIR COOLED, LARGE SCALE, FLOATING LNG PRODUCTION WITH LIQUEFACTION GAS AS ONLY REFRIGERANT

(71) Applicants: Global LNG Services AS, Oslo (NO); Tor Christensen, Sandefjord (NO); Pål Leo Eckbo, Hanover, NH (US)

(72) Inventors: Tor Christensen, Sandefjord (NO); Pål Leo Eckbo, Hanover, NH (US)

( * ) Notice: Subject to any disclaimer, the term of this patent is extended or adjusted under 35 U.S.C. 154(b) by 290 days.

(21) Appl. No.: 16/166,569

(22) Filed: Oct. 22, 2018

(65) Prior Publication Data

US 2020/0003489 A1 Jan. 2, 2020

Related U.S. Application Data

(60) Provisional application No. 62/691,235, filed on Jun. 28, 2018.

(51) Int. Cl.
*F25J 1/02* (2006.01)
*F25J 1/00* (2006.01)

(52) U.S. Cl.
CPC ..... *F25J 1/0277* (2013.01); *F25J 1/0022* (2013.01); *F25J 1/0037* (2013.01); *F25J 1/0283* (2013.01); *F25J 1/0298* (2013.01); *F25J 2290/72* (2013.01)

(58) Field of Classification Search
CPC ..... B63H 21/38; F25J 1/0277; F25J 1/0022; F25J 1/0037; F25J 1/0283; F25J 1/0298; F25J 2290/72; F25J 2210/06; F25J 2220/64; F25J 2220/68; F25J 2230/08; F25J 2230/60; F25J 2245/90; F25J 2290/60; F25J 2290/62; F25J 1/023; F25J 1/0244; F25J 1/0259; F25J 1/0269; F25J 1/0278; F25J 1/0296
See application file for complete search history.

(56) References Cited

U.S. PATENT DOCUMENTS 3,735,601 A * 5/1973 Stannard, Jr. ..... F25J 1/0052 62/87
4,317,474 A * 3/1982 Kentosh ..... B63B 21/00 137/615
4,433,940 A * 2/1984 Harrison ..... F17C 3/005 405/210
5,025,860 A * 6/1991 Mandrin ..... F25J 1/0285 166/267
5,878,814 A * 3/1999 Breivik ..... B63B 22/021 166/267
5,983,931 A * 11/1999 Ingebrigtsen ..... B63B 22/026 137/580

(Continued)

FOREIGN PATENT DOCUMENTS

CA 3 027 085 * 2/2019
WO WO 2017/135804 A1 * 8/2017

(Continued)

*Primary Examiner* — Ljiljana V. Ciric
(74) *Attorney, Agent, or Firm* — Shackelford, Bowen, McKinley & Norton, LLP

(57) ABSTRACT

A method for large-scale, air-cooled floating liquefaction, storage and offloading of natural gas gathered from onshore gas pipeline networks. Gas gathered from on-shore pipeline quality gas sources and pre-treated to remove unwanted compounds is compressed and cooled onshore before being piped to an offshore vessel for liquefaction to produce LNG.

7 Claims, 6 Drawing Sheets

(56) References Cited

U.S. PATENT DOCUMENTS 6,003,603 A * 12/1999 Breivik ..... B63B 21/508 166/357
6,412,302 B1 * 7/2002 Foglietta ..... F25J 1/0022 62/611
6,793,712 B2 * 9/2004 Qualls ..... B01D 53/1456 62/611
6,889,522 B2 * 5/2005 Prible ..... F25J 1/0022 62/611
6,973,948 B2 * 12/2005 Pollack ..... B63B 21/50 141/284
6,997,643 B2 * 2/2006 Wille ..... B63B 21/507 144/230.1
7,007,623 B2 * 3/2006 Boatman ..... B63B 21/50 114/230.15
7,080,673 B2 * 7/2006 Pollack ..... F17C 5/06 141/284
7,318,319 B2 * 1/2008 Hubbard ..... F17C 3/04 141/387
7,600,396 B2 * 10/2009 Mak ..... F25J 3/0242 62/620
7,717,762 B2 * 5/2010 Boatman ..... B63B 22/023 441/3
7,958,835 B2 * 6/2011 Srinivasan ..... B63B 35/4413 114/264
8,037,694 B2 * 10/2011 Runbalk ..... F25J 1/0248 62/50.2
8,100,076 B1 * 1/2012 Shivers, III ..... B63B 27/30 114/230.14
8,104,416 B1 * 1/2012 Shivers, III ..... B63B 27/24 114/230.14
8,640,493 B1 * 2/2014 Shivers, III ..... F25J 1/0288 62/611
9,493,216 B2 * 11/2016 Scott ..... F25J 1/0022
10,359,229 B2 * 7/2019 Isaacson ..... B63B 25/16
10,549,820 B2 * 2/2020 Lane ..... B63B 21/00
10,668,989 B2 * 6/2020 Hellesmark ..... B63B 21/56
2004/0244986 A1 * 12/2004 Poldervaart ..... B63B 21/507 166/367
2007/0095427 A1 * 5/2007 Ehrhardt ..... B63B 21/507 141/387
2010/0108145 A1 * 5/2010 Danaczko ..... B63B 27/24 137/1
2011/0265494 A1 * 11/2011 Barclay ..... F25J 1/0208 62/45.1
2012/0024391 A1 * 2/2012 Wille ..... B65G 5/00 137/1
2012/0317996 A1 * 12/2012 Lee ..... F17C 5/02 62/50.1
2013/0025726 A1 * 1/2013 Dupont ..... B63B 27/24 137/899.2
2016/0231050 A1 * 8/2016 Faka ..... F25J 1/0022
2016/0313057 A1 10/2016 Roberts et al.
2017/0016666 A1 * 1/2017 Scott ..... F25J 1/0278
2020/0124345 A1 * 4/2020 Christensen ..... F25J 1/0042
2020/0317305 A1 * 10/2020 Kim ..... B63B 35/44
2020/0386473 A1 * 12/2020 Becker ..... B63B 25/16

FOREIGN PATENT DOCUMENTS

WO WO 2017/209368 A1 * 8/2017
WO WO 2018/200714 A1 * 11/2018

* cited by examiner

METHOD FOR AIR COOLED, LARGE SCALE, FLOATING LNG PRODUCTION WITH LIQUEFACTION GAS AS ONLY REFRIGERANT

TECHNICAL FIELD

The present invention relates to coastal production of liquefied natural gas, with maximum exploitation of the economies of scale, where gas processing occurs in two locations, pipeline gas gathering and pre-processing onshore and piping of the gas to a ship shaped coastal floating LNG liquefaction, storage and offloading unit. Specifically, the liquefaction capacity on the floating LNG liquefaction, storage and offloading unit is maximized within constraints imposed by available space for power production, by the exclusive use of air cooling, by the use of multiple inherently safe, medium size liquefaction processes, by the use of liquefaction gas as the only refrigerant, and by the use of standard, dock-able ship sizes.

BACKGROUND ART

Natural gas is becoming more important as the world's energy demand increases as well as its concerns about air and water emissions increase. Gas is much cleaner-burning than oil and coal, and does not have the hazard or waste deposition problems associated with nuclear power. The emission of greenhouse gas is lower than for oil, and only about one third of such emissions resulting from combustion of coal. Natural gas is readily available, from gas reservoirs, from shale gas, from gas associated with oil production, from pipelines in industrialized areas, and from stranded gas sources far from infrastructures.

When gas pipelines are uneconomic or impractical, such as transportation of gas over very large oceanic distances, the best way to transport gas is often in the form of Liquefied Natural Gas (LNG), which is gas cooled to about −160° C. to form a stable liquid at or very near atmospheric pressure. Suitable gas mainly comprises methane with some ethane, propane, butane, pentane and traces of nitrogen.

LNG is produced using two major processing steps. The first step, taking place at typically 40 to 60 bara, is gas pre-treatment to remove free water, mercury, $H_2S$, $CO_2$, water vapour and finally heavy hydrocarbons. Specification for residual mercury is typically <0.01 μg/Nm3, for residual $H_2S$<2 ppmv, for residual $CO_2$<50 ppmv, and, of critical importance, for water vapour a very low value of <0.1 ppmv. After removal of these components, heavy hydrocarbons are removed such that the concentration of residual pentane and heavier is less than 1000 ppm, while the concentration of residual hexane and heavier is less than 100 ppm. The resulting liquefaction ready gas may typically contain methane concentration above 85% on a molar basis, often well above 90%, ethane in the range from below 1 to about 10%, propane in the range from below 0.1 to about 3%, with butane and pentane in the range from below 0.1 to 1%. Nitrogen concentration may be in the range from below 0.1 to 2%.

The second processing step is liquefaction of the thus purified gas, which then comprises mainly methane. This occurs at the same pressure as the gas pre-processing, or, in some cases, preferentially at higher pressures such as 70 to 100 bara. After liquefaction nitrogen may be removed from the LNG, typically any amount that exceeds 1 mole %. This is done by flashing of the LNG at near atmospheric pressure. This flash produces the final LNG product, and a much smaller hydrocarbon gas stream enriched in nitrogen, mainly used for fuel. The final LNG product is liquid at atmospheric pressure and about −160° C. It is stored in buffer storage tanks before being transported to destinations in LNG tankers. At the destination, the LNG is re-gasified and distributed to consumers.

Single train LNG plant sizes range from less than 0.05 million tons annually (MTPA) for peak-shaving plants, via small to medium scale LNG plants in the range from 0.05 to about 2.0 MTPA, to large conventional plants producing 4.0 MTPA or more. Larger production rates may be accomplished in multiple parallel LNG plants.

The safest natural gas liquefaction processes employ nitrogen or lean natural gas refrigerant. One novel process, the AP-C1 licensed by Air Products and Chemicals Inc., uses lean natural gas refrigerant only, eliminating the need for production and storage of nitrogen or flammable mixed hydrocarbon refrigerants.

When using nitrogen refrigerant, the only components present in the liquefaction process are nitrogen and lean natural gas. The nitrogen is completely inert. The lean natural gas, mainly methane, also has excellent safety properties in that initiation energy for immediate detonation is very high, much higher than for hydrocarbons used in mixed refrigerant processes, making detonation extremely unlikely. Furthermore, natural gas is much lighter than air and any leak will quickly rise away from the process area.

The main change when using natural gas refrigerant instead of nitrogen is that the nitrogen with associated nitrogen production and storage are eliminated, reducing weight and space requirements. Natural gas is out of necessity still present, as it was when using nitrogen refrigerant. The safety impact when eliminating nitrogen is therefore small in particular when the inventory of natural gas refrigerant is minimized.

The specific liquefaction energy for liquefaction processes employing natural gas refrigerant does, as is the case for any liquefaction process, depend on water or air coolant temperature, on gas composition and heat transfer properties, on cryogenic heat exchanger warm and cold side temperature differences, and on rotating equipment efficiencies. The specific energy consumption for natural gas refrigerant may be about the same as for the more hazardous single mixed refrigerant liquefaction processes, such as for example about 350 kWh per metric ton LNG.

Recent technical developments have provided possibilities for gas liquefaction on floating vessels, FLNG. This is attractive because the liquefaction can be done near the gas source, which is often in coastal areas or further offshore. The vessel may provide space for liquefaction processes as well as buffer storage for LNG. In addition vessels may serve as deep-water export terminals.

U.S. Pat. No. 8,640,493 B1 describes a method for offshore liquefaction of natural gas from sub-sea wells, comprising an on-site gas production platform that also pre-processes and compresses the gas, transfer of the gas to a dis-connectable transport vessel in close proximity, that also assists liquefaction, and disconnection and travel by the transport vessel to a terminal for offloading. During this transportation there is no LNG production.

US2016/0313057 A1 by Air Products and Chemicals Inc. discloses a refrigeration system for liquefaction of natural gas using a refrigerant based on only the liquefaction gas itself, which is mainly methane. The liquefaction gas is first cooled and liquefied by heat exchange with cold refrigerant and then expanded to lower pressure in one or more steps. Each step reduces the temperature to the boiling point of the fluid at the pressure in question and produces a mixture of gas and liquid. The gas is compressed and recycled, and the liquid becomes the LNG product.

The object of the present invention is to provide a method for very large scale floating, uninterrupted LNG production, using gas supplied and pre-processed on-shore including dehydration to about 0.1 ppmv $H_2O$, piped in a pipeline, part of which is sub-sea, to t an offshore floating liquefaction, storage and offloading facility where the liquefaction process inlet verifies and rectifies the dehydration status as required at a cost that competes with land-based LNG production at the same scale and in the same geographical region, using a liquefaction process that employs natural gas or methane refrigerant only, such as for example a process licensed by the owner of US2016/0313057 A1.

SUMMARY OF INVENTION

According to the present invention relates to a method for A method for large scale, air cooled floating liquefaction, storage and offloading of natural gas, the method comprising:

a) Gas gathering from on-shore sources and treating the gas on shore by removal of mercury, removal of acid gas, dehydration and removal of C6+ hydrocarbons,
b) on-shore compression and cooling of the treated gas;
c) piping of the compressed gas from onshore to an offshore pipeline end manifold;
d) piping of gas from the pipeline end manifold to an offshore ship shaped, external turret moored vessel;
e) reception of the gas on the vessel via a swivel mounted on the turret;
f) distribution of the gas to three parallel liquefaction trains on the vessel;
g) gas liquefaction by methane refrigerant and subsequent flash;
h) cooling the gas from compressors by heat exchange with water;
i) heating the cooling water to 80° C. or higher downstream process heat exchangers;
j) cooling of the cooling water by heat exchange with air in air coolers:
k) air coolers mounted on at least three mechanically independent cantilevers, in total extending at least 50% of the vessel length;
l) recycling the cooled cooling water to process heat exchangers;
m) gas turbine air intakes for liquefaction and utilities located on the opposite side of the air cooler cantilevers;
n) sending LNG that is not completely stabilized to storage tanks;
o) storing produced LNG in multiple smaller membrane tanks onboard the vessel;
p) flashing LNG in the storage tanks;
q) gas offloading to LNG tank vessels while the liquefaction processes are in full production.

According to one embodiment, the gas offloading is done by means of offloading arms located on the side of the ship shaped, external turret moored vessel being opposite of the cantilever air coolers.

According to another embodiment, the gas offloading is done by means of parallel offloading.

According to one embodiment, the gas is gathered from onshore pipeline networks.

According to one embodiment, flash gas from the LNG storage tanks is used as fuel gas onboard the vessel.

According to one embodiment, the water content in the gas received onboard the vessel is monitored, and that the incoming gas is dehydrated before introduction into step f) if the water content of the gas is above a pre-set level.

DETAILED DESCRIPTION OF THE EMBODIMENTS

Figure 1:
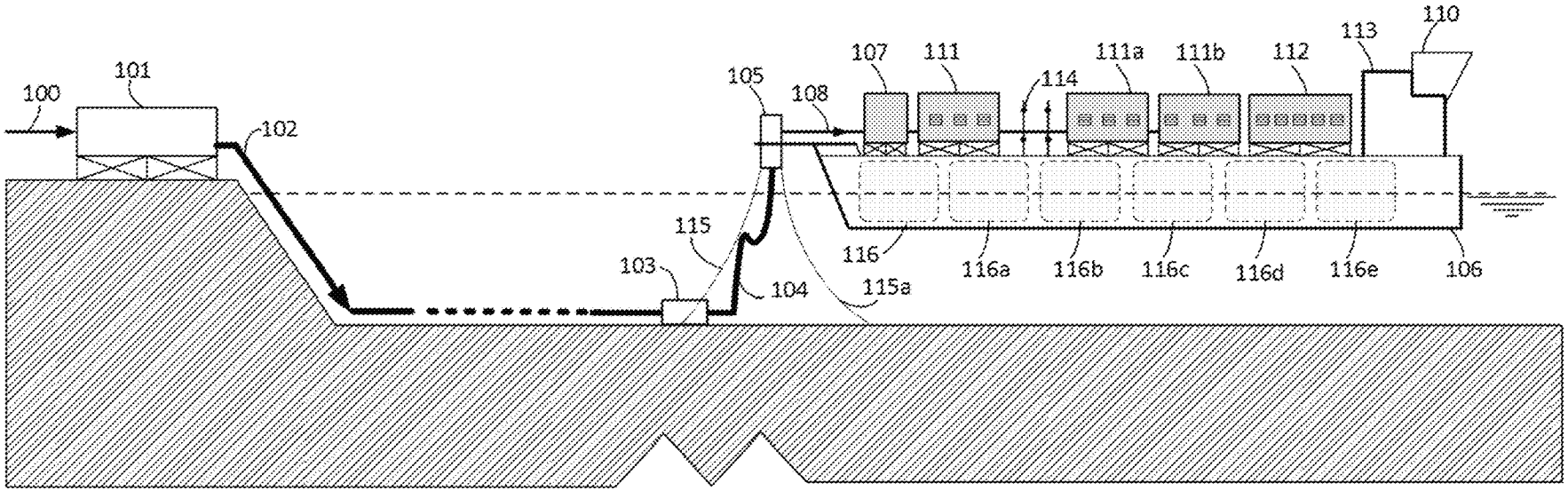
FIG. 1 is a side view diagram of an arrangement for very large scale floating production, storage and offloading of LNG where the gas is gathered from onshore sources, pre-processed onshore including dehydration, then piped to an offshore, permanently moored gas liquefaction, storage and offloading vessel. The liquefaction process is fully air cooled with air coolers mounted on a cantilever, usable in an embodiment of the method.

In the present description and claims the term "natural gas" or "gas" is used for a gas comprising low molecular weight hydrocarbons, which during cooling to produce LNG might be under sufficient pressure to may be in a supercritical state, where it remains a single phase, or at lower pressures where, depending on temperature, there may be gas only, mixtures of gas and liquid, or liquid only. The cooling process may include pre-cooling, which may be any degree of cooling down to about −100° C., and final cooling which is further cooling to LNG temperature, where the LNG is stable, or gives only very small amounts of gas, such as 1 to 4% on mass basis, when fully expanded to atmospheric pressure. In some cases the term "cooling" is used for both pre-cooling and final cooling.

Natural gas is found in geological formations either together with oil, in gas fields, and in shale as shale gas. Dependent on the source, natural gas may differ in hydrocarbon composition, but methane is almost always the predominant gas. The skilled person within this technical area will have good knowledge of the abbreviations LNG and NGL, i.e., Liquefied Natural Gas, and Natural Gas Liquids, respectively. LNG consists of methane normally with a minor concentration of $C_2$, $C_3$ $C_4$ and $C_5$ hydrocarbons, and virtually no $C_{6+}$ hydrocarbons. LNG is a liquid at atmospheric pressure at about −160° C., a temperature which in the present description is called "LNG temperature". NGL, on the other hand, is a collective term for mainly $C_{3+}$ hydrocarbons, which exist in unprocessed natural gas. LPG is an abbreviation for liquefied petroleum gas and consists mainly of propane and butane.

The pressure is herein given in the unit "bara" is "bar absolute". Accordingly, 1.013 bara is the normal atmospheric pressure at sea level. In SI units, 1 bar corresponds to 100 kPa.

The expression "ambient temperature" as used herein may differ with the climate for operation of the plant according to the present invention. Normally, the ambient temperature for operation of the present plant is from about 0 to 40° C., but the ambient temperature may also be from sub-zero levels to somewhat higher than 40° C., such as 50° C., during some operating conditions.

The invention relates to a method for very large scale floating production of liquefied natural gas, in coastal areas, at a scale and with capital expenditure and efficiency that can compete with on-shore gas liquefaction in the same geographical region and from the same on-shore gas sources. It further relates to the locations where processing takes place, with gas pre-processing on-shore, piping of gas to offshore where liquefaction, storage and offloading takes place, and to specific requirements for the system, including air instead of water cooling of the liquefaction process especially in coastal areas, combined with verification and any rectifying of the gas dehydration status after transport in sub-sea pipelines.

The on-shore gas pre-processing may preferably be in the vicinity of a natural gas pipeline network or other source which can provide the required amounts of gas.

The pre-processed gas is compressed and piped in rigid, large scale pipes from the first location, onshore, to second process location, typically 10 to 100 kilometres offshore. At this second location, there are one or more ship-shaped, permanently moored liquefaction, storage and offloading vessel(s) with very large liquefaction capacity such as 12 million tonnes per year or 2 to 3 times more than the largest floating production made so far. These vessel(s) also serve as deep-water port(s) for the loading of LNG trade tankers.

At the first process location, onshore, gas such as for example pipeline quality gas can be gathered from regional gas sources. This gas normally does not adhere to LNG specifications for maximum content of a range of contaminants including Hg, $H_2S$, $CO_2$, water and NGLs. Therefore, the onshore process is designed to remove excess amounts of contaminants.

Mercury vapour can be removed by an adsorbent that irreversibly binds the mercury. Downstream of this, the process can remove any excess amounts of acid gases, mainly $CO_2$ and $H_2S$.

Acid gases can be absorbed in a counter-current absorption column using an aqueous amine solution. The amine solution is subsequently regenerated by temperature and pressure swing, and then recirculated to the absorption column for re-use.

Water vapour may be removed by adsorption in a molecular sieve. Molecular sieves are capable of adsorbing water to levels where no water precipitates at LNG temperatures such as 0.1 ppm. The molecular sieve is fully regenerable by flowing warm, dehydrated gas over the adsorbent in a direction opposite to the adsorption flow. The humid gas from the regeneration process can be cooled to precipitate and separate water, and the gas is then re-cycled to a point upstream the dehydration process inlet.

Further onshore gas processing can include gas cooling and subsequent expansion in a turbo expander. This produces low temperatures fluid, for example −30 to −60° C. that comprises a gas and a liquid phase. The gas becomes the pre-treated liquefaction gas while the liquid, mainly C6+, may be stabilized forming stable NGL and used as fuel or sold separately.

All of the above pre-processing can take place at for example 40 to 60 bara. On-shore gas compression to for example 110 to 140 bara is needed for pipeline transport of the gas. This has the additional advantage of reducing the gas enthalpy, thus facilitating the later on-board gas liquefaction. The pipeline transportation of the gas, for example over 100 miles, much of which is sub-sea, introduces a risk of water contamination of the gas either from $H_2O$ in the pipeline or from $H_2O$ ingress into the pipeline.

Near the off-shore facility there may be a gas receiving and re-distribution arrangement such as a pipeline end manifold or a local platform where the gas may be metered and distributed via rigid and/or flexible pipe systems to one or more floating liquefaction, storage and offloading ship shaped vessels.

The ship shaped vessel has limited functionality with dehydration arranged to verify and if necessary rectify the gas dehydration status where the maximum allowable water content is 0.1 ppmv, gas liquefaction, LNG storage and LNG offloading.

This limited functionality frees up deck space and enables very large liquefaction capacity, such as 10 to 12 million tonnes LNG per annum (MTPA) per vessel, providing full exploitation of the economies of scale. The liquefaction process can be air cooled, and the air coolers can be mounted on a cantilever for free access to air and large air cooler area that maximizes the cooling capacity and minimizes the process fluid to air approach temperatures. Preferably, the vessel has the maximum size that can be accommodated in standard size yard docks such as length about 380-400 m and breadth about 64 m, to allow for maintenance of the hull without needing special docks.

For maximum LNG storage and minimum cost the vessel can be moored using an external turret. The vessel can gyrate around the turret, such that the heading is determined by the combined forces of wind, sea current and thrusters. Gas can be supplied from the gas receiving and distribution unit via flexible risers and a swivel mounted in the centre of the turret, enabling free gas flow from a fixed point at the sea floor to the vessel deck that may repeatedly revolve around the turret.

Gas from the swivel can be checked for any contamination, especially water vapour, and re-dehydrated in a dehydration unit should excessive water, above 0.1 ppm, be detected. Downstream of this gas quality reassurance the gas can be piped to one or more parallel liquefaction trains, based on a refrigerant that is the gas itself or that can easily be derived from the gas and freely re-introduced into the liquefaction gas flow as required.

The vessel hull naturally serves as LNG buffer storage. There may be multiple independent membrane tanks to minimize sloshing and effects of sloshing, such as 12 tanks, 6 on port side and 6 on the starboard side, each with for example about 25,000 m3 storage volume. The membrane tanks provide for a flat vessel deck and the full deck, except space occupied by offloading facilities, can be used for liquefaction process with associated utility equipment and accommodations.

The vessel can naturally serve as a deep-water port located outside busy shipping lanes. LNG can be transferred to LNG trade tankers without production interruption. LNG offloading may be based on the technology that provides the safest, fastest and most reliable technology. This may be the proven side by side offloading, where the trade tanker is berthed along the vessel side and LNG is transferred via offloading arms, or the novel parallel offloading where the trade tanker is located behind the vessel, at some safe distance, and LNG is transferred via flexible hoses either suspended in the air or floating on the sea surface.

The liquefaction processes can operate for example 335 to 345 days per year, allowing about 10 to 20 days for maintenance and 10 days shutdown during severe weather.

Recent developments in gas production have uncovered vast new gas resources. One is onshore fracking technology, which now supplies gas to pipeline networks including networks in coastal regions. Another is two phase flow technology in large pipelines, enabling the pipeline transportation of offshore gas and liquids to shore in a single pipe. A third is associated gas from large oil production facilities.

This invention aims to optimize the exploitation and transport of such gas resources in a cost efficient, environmentally friendly and safe manner.

Some jurisdictions possess vast gas reserves offshore, not too far from the coast. These jurisdictions often want the gas landed on-shore such that parts of the gas can be used for local consumption. New pipeline technologies enable the landing of such gas even if it becomes two phase pipe flow and the flow is up-hill. Depending on political stability, however, gas exporters may not want the gas landed, because all of their most expensive equipment could be exposed should unrest erupt. This invention provides a cost efficient compromise, where untreated gas can be landed onshore in multi-phase pipelines, partly prepared for local consumption, and partly dedicated to liquefaction. With this invention liquefaction can take place offshore, and the expensive liquefaction and LNG storage and offloading systems will be less exposed to any local instabilities. At the same time, the project will have significant local content and provide work for local populations.

A further advantage with the invention is the separation of gas pre-processing and gas liquefaction. The site specific facilities, the pre-processing, is the only part that must be tailor made for each project. The second process location, the liquefaction vessel, will treat gas with fairly uniform composition and properties, regardless of project location. It can therefore be standardised for use virtually anywhere with minor modifications. Benefits are especially important if more than one LNG site is developed.

The offshore vessel can to a large degree be constructed in the controlled environment of a ship yard. Furthermore, the process can be modularized to save cost.

The use of natural gas as the only refrigerant, in combination with minimization of gas inventory on the vessel deck, provides safety at the same level as nitrogen refrigerant systems.

Air cooling of the liquefaction process delivers the best environmental performance. Indirect cooling may be used, with circulating water between the main sources of heat, compressor inter and aftercoolers, and the air coolers. This optimizes the cooling capacity because the limited heat transfer area in the air coolers is better utilized.

The following narrative provides a description of the drawings and an example.

FIG. 1 shows a side view of the overall system. Pipeline quality gas is introduced via a conduit 100 to an onshore pre-processing plant 101. Pre-processed gas, without compounds that can contaminate downstream equipment of form solids in cryogenic processes is piped in pipeline 102 to a pipeline end manifold 103, or alternatively to a small gas reception platform, near a floating liquefaction, storage and offloading vessel 106. From the pipeline end manifold 103 the gas is directed to a vessel turret 105, that also has a swivel, via a flexible conduit 104. Persons skilled in the art will know that the flexible pipe 104 may comprise one or more parallel units, such as for example 4, as smaller flexible pipes provide better flexibility properties, and that the swivel enables the transfer of gas from flexible hoses to the gyrating vessel.

The vessel 106 is moored using the external turret and a number of mooring chains, such as for example 20, of which two are shown, 115 and 115*a*.

On the vessel, gas is distributed to multiple processing modules via a manifold 108. The first processing module 107 is an optional gas dehydration unit. The gas was dehydrated on shore, in the onshore pre-processing plant 101. However, piping to offshore may have caused some water ingress. Any such water can be removed in the unit 107.

Downstream of the dehydration unit three gas liquefaction plants 111, 111*a* and 111*b*, are illustrated. Each unit is powered by three gas turbines optionally in combination with not shown electric motors. Gas turbines are located on the side of the vessel for efficient air intake.

On the same side of the vessel as the gas turbine air intake there are side by side offloading arms 114. Alternatively, a not shown parallel offloading arrangement, or any other suitable offloading arrangement, may be employed. Furthermore, there is a utility module 112 providing electric power and other utilities such as fresh water and instrument air. Aft there are accommodations 113 and a helipad 110.

The vessel, being a liquefaction, storage and offloading unit, has multiple LNG storage tanks 116, 116*a-e*. Six are shown on the vessel port side, with additional not shown six tanks on the starboard side. The use of multiple tanks allows for vessel flexing and minimizes the effects of LNG sloshing.

Figure 2:
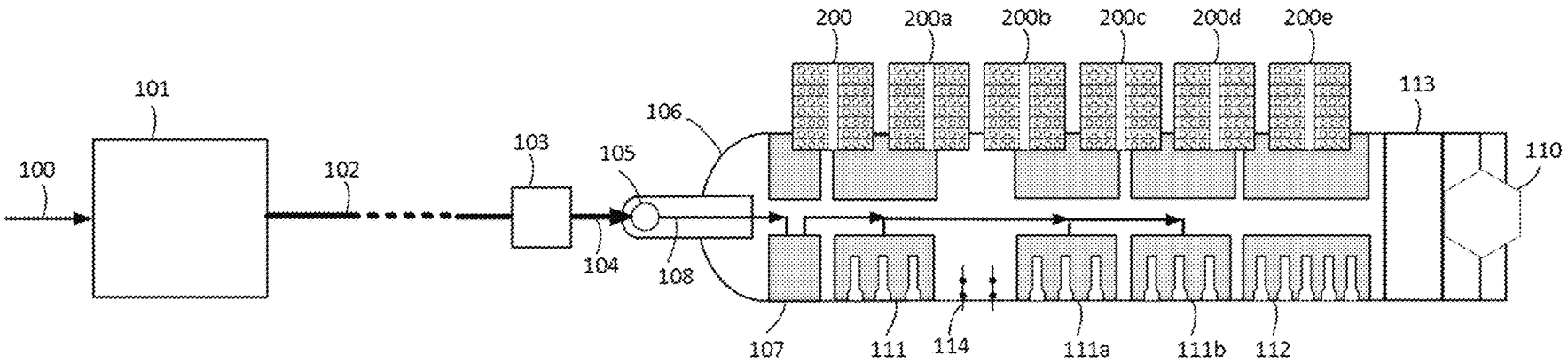
FIG. 2 is a top view diagram of the FIG. 1 arrangement, the very large scale floating production, storage and offloading of LNG from onshore sources, usable in an embodiment of the method.

FIG. 2 shows a top view of the overall system. Gas feed, pre-processing and transport to offshore are the same as shown in FIG. 1. Processing and utilities modules 107, 111, 111*a* and *b* and 112 are also the same as shown in FIG. 1, however, FIG. 2 shows that these all extend from the vessel port side to the manifold 108, with a gap for pipe arrangements, then further on the opposite side of the vessel all the way across the deck. The liquefaction plants are cooled by air coolers 200, 200*a-e*, arranged on six independent cantilevers to allow for vessel flexing, on the opposite side of the gas turbine air intakes. The cantilevers extend mainly over the sea, high up from the sea surface, to minimize exposure to seawater and to ensure unhindered air flow. They also extend along most of the vessel length, such as more than 60% of the length of the vessel, such as more than 70%, or more than 80% of the length of the vessel, for maximum cooling area.

Figure 3:
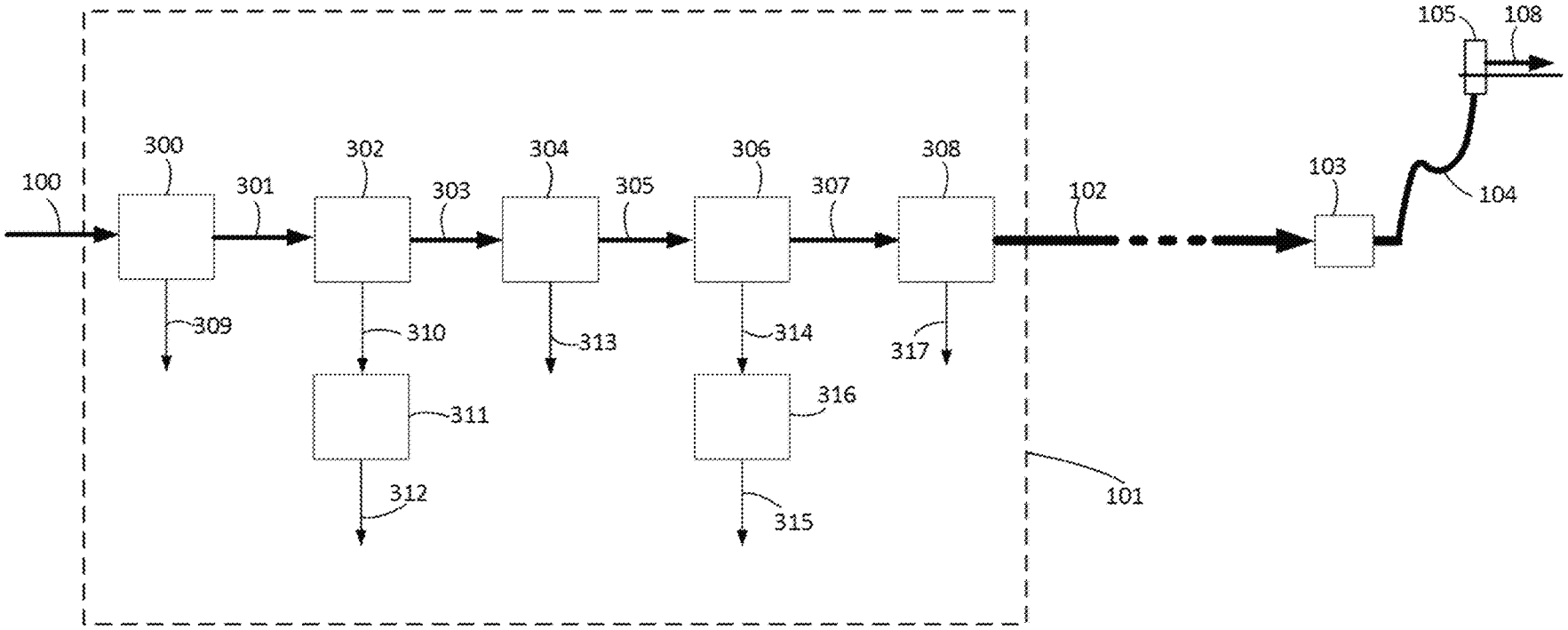
FIG. 3 is a schematic diagram of an arrangement of the onshore gas pre-processing process with mercury and sour gas removal, dehydration, heavy hydrocarbon removal and compression for piping to offshore facilities, usable in an embodiment of the method.

FIG. 3 shows the sequence of processes located on shore, at the onshore pre-processing plant 101. Gas is received via the conduit 100 is treated in a mercury removal unit 300. Mercury is irreversibly absorbed on a pre-sulfided metal oxide absorbent. Spent absorbent is removed batch-wise in a stream 309 after several years of operation, and replaced via a not shown input stream.

The treated gas from unit 300 is directed to an acid gas removal unit 302 via a conduit 301. The acid gases are mainly $H_2S$ and $CO_2$. Both the acid gases can be removed from the hydrocarbon gas by selective and reversible absorption into a suitable absorbent, typically an amine/water solution. The absorption can be accomplished by counter-current flow of gas and absorbent in a packed column at near ambient temperature. The rich absorbent, loaded with the acid gases, can be re-generated by pressure reduction, heating and stripping with steam. The regenerated absorbent is re-cycled for re-use, and the treated, sweet hydrocarbon gas can be directed to a dehydration unit 304 via a conduit 303.

The separated acid gases can be removed in a conduit 310. The skilled person will understand that further treatment may be necessary to remove the toxic gas $H_2S$. This may be done by oxidation, producing $SO_2$, which is subsequently captured by scrubbing with water, in a unit 311. The thus purified $CO_2$ may be removed via a conduit 312, and the scrubbing water via a separate, not shown conduit.

In the unit 304, the gas is dehydrated by $H_2O$ adsorption in a molecular sieve such as a synthetic zeolite bed. Suitable zeolites have an extremely strong affinity for $H_2O$. Within the zeolite bed, there are three zones, one at the gas inlet that is nearly saturated with $H_2O$, followed by an adsorption zone where $H_2O$ is actively adsorbed, and a third zone that is normally dry, polishing the gas from upstream zones. The adsorption takes place at near ambient temperature. The zeolite can be fully regenerated, controlled by timers such that of for example three adsorption units, two can be in adsorption mode and one can be in regeneration mode in eight hour cycles. Regeneration can be accomplished by flowing dry gas over the zeolite bed at high temperature such as for example 300° C., in a direction opposite to the adsorption flow. The regeneration gas can be cooled to precipitate water and then re-cycled upstream the dehydration or acid gas removal unit in a not shown conduit. Water from the dehydration unit can be removed in a conduit 313 and dry gas is directed to a unit for the removal of heavy hydrocarbons 306 via a conduit 305.

Heavy hydrocarbons, or hydrocarbons that can form solids at cryogenic temperatures, such as $C_6$+ and some aromatics, can be removed from the gas by cooling such that they become liquids and then separated in a liquid knock-out tank. These liquids can then be stabilized and exported. The remaining gas will be liquefaction ready.

The cooling of the gas can be accomplished in two stages, first pre-cooling in a heat exchanger and then expansion to the pressure and temperature most suitable for the liquid formation process. After separation, the resulting gas and liquid can be used as coolants in said heat exchanger. Power from the expander, if a turbo expander is employed, can drive a compressor for partial gas re-compression of the liquefaction ready gas. Stabilized, heavy hydrocarbons are removed from the process in a conduit 314, stabilized in a unit 316 and finally removed in a conduit 315. Liquefaction ready gas is directed to a gas compressor 308 via a conduit 307. The skilled person will understand that the compressor 308 preferably comprise two or more serially and/or parallel connected compressors.

While gas pre-treatment can be done at moderate pressures such as 30 to 60 bara, higher pressure such as 110 to 140 bara is much better for pipeline transport of liquefaction ready gas to offshore and much better for liquefaction offshore since the higher pressure gas has reduced enthalpy. The compression can be done by means of gas turbine driven axial compressors with not shown air inter- and after-coolers. After side draw of fuel gas in a conduit 317 the compressed and cooled gas is directed offshore to the floating vessel via the pipeline 102, the pipeline end manifold 103, the riser 104, the turret 105 with associated swivel and the vessel manifold 108.

Figure 4:
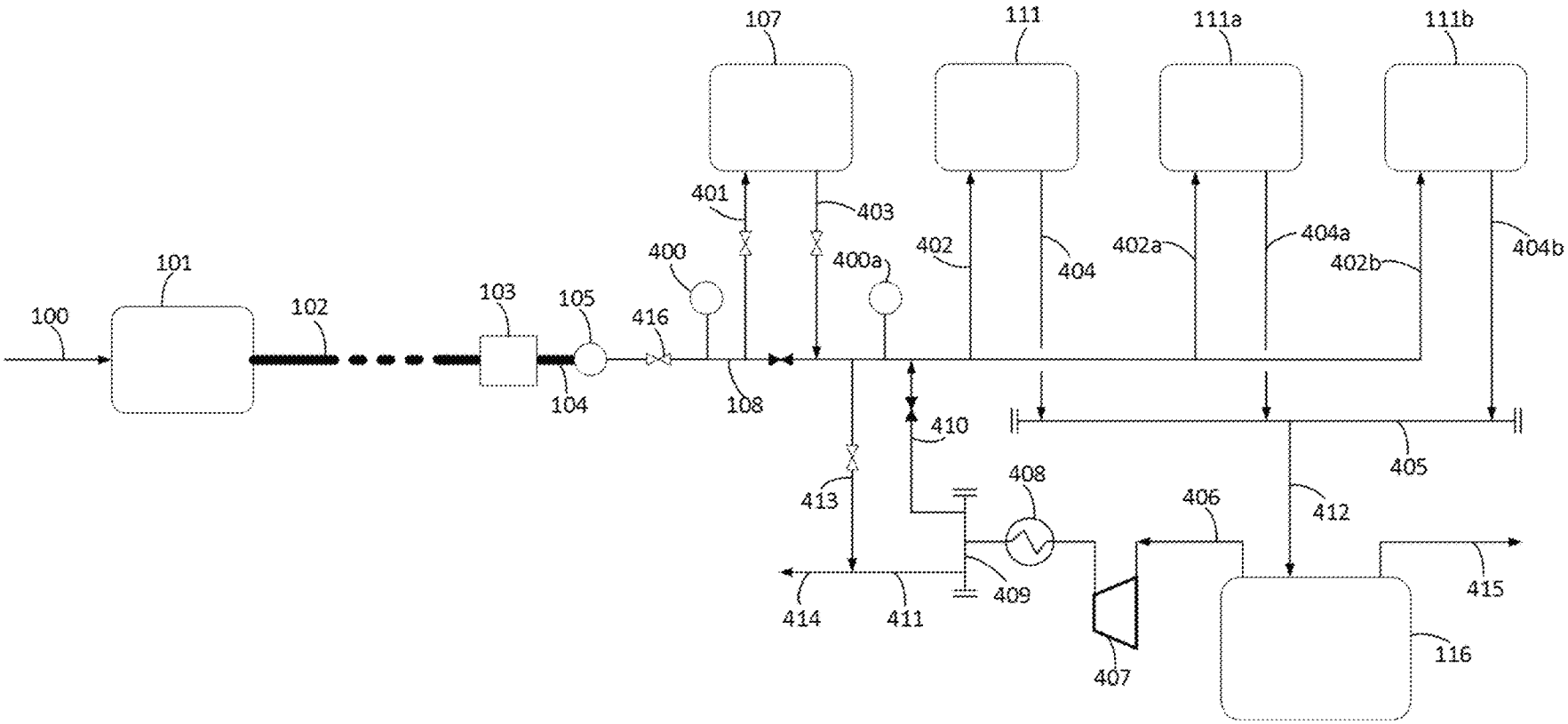
FIG. 4 is a schematic diagram of an arrangement of overall mass flow through the complete LNG production train, showing gas pre-processing on shore, pipeline transport to offshore, duplicate gas dehydration offshore, gas liquefaction offshore, LNG storage offshore, boil-off gas compression offshore and LNG offloading offshore, usable in an embodiment of the method.

FIG. 4 shows an overview of the hydrocarbon flow in the complete gas liquefaction system. Natural gas from the conduit 100 is pre-processed including dehydration to a residual $H_2O$ content of 0.1 ppm on a volume basis (water dew point roughly −80° C. or lower) in the on-shore pre-processing plant 101. The gas is piped to the offshore pipeline end manifold 103, next via the risers 104, turret 105 with associated swivel and a valve for back-pressure control 416, to the vessel manifold 108. At the inlet to the manifold there is a hygrometer 400. The hygrometer 400 will show whether there is residual $H_2O$ in the gas. This may occur for example during start-up or if there is $H_2O$ ingress into the gas as result of diffusion or leaks. Without dehydration capacity on the vessel such water would cause severe problems in that large volumes of gas in the pipelines would have to be disposed of and location of water ingress identified, causing unplanned shut-down and possibly gas flaring.

Downstream the hygrometer 400 the gas may optionally be directed to a dehydration unit 107 via a conduit 401. Dehydrated gas is returned to the vessel manifold 108*a* and the humidity is next measured in a hygrometer 400*a* to determine residual $H_2O$ content and readiness for cryogenic temperatures.

Downstream, the gas is distributed to the parallel liquefaction trains 111, 111*a* and 111*b* via conduits 402, 402*a* and 402*b* respectively. LNG that is stable slightly above atmospheric pressure, such as for example 1.5 bara, is directed to a manifold 405 via conduits 404, 404*a* and 404*b*. From the manifold 405 the LNG is directed to the LNG storage 116 via a conduit 412.

In the storage 116 the LNG pressure is near atmospheric, such as about 1.05 bara. The LNG will flash upon entering the low pressure storage, producing boil-off gas. Boil-off gas is also produced as result of heat ingress into the LNG storage tanks and vapour displacement as LNG fills the tanks.

The boil-off gas is removed from the tank in a conduit 406, compressed in a compressor 407, cooled in a cooler 408, and directed to a manifold 409. Gas flow in this manifold balances the boil-off gas recycle to re-liquefaction via a conduit 410 and boil-off gas needed as fuel gas, directed to a not shown fuel gas system via a conduit 411, and is withdrawn via a conduit 414 as fuel gas. If the boil-off gas is insufficient for fuel gas, fuel gas may be supplemented from the liquefaction feed gas distribution conduit 108*a* via a conduit 413. This gas ca be mixed with compressed boil-off gas in the conduit 411 and the combined flow provides all necessary fuel via the conduit 414.

LNG may be offloaded via a conduit 415 and the offloading arms 114 or alternatively not shown flexible offloading hoses for parallel offloading. The offloading is accomplished by using not shown, submerged LNG pumps in the tanks 116.

Figure 5:
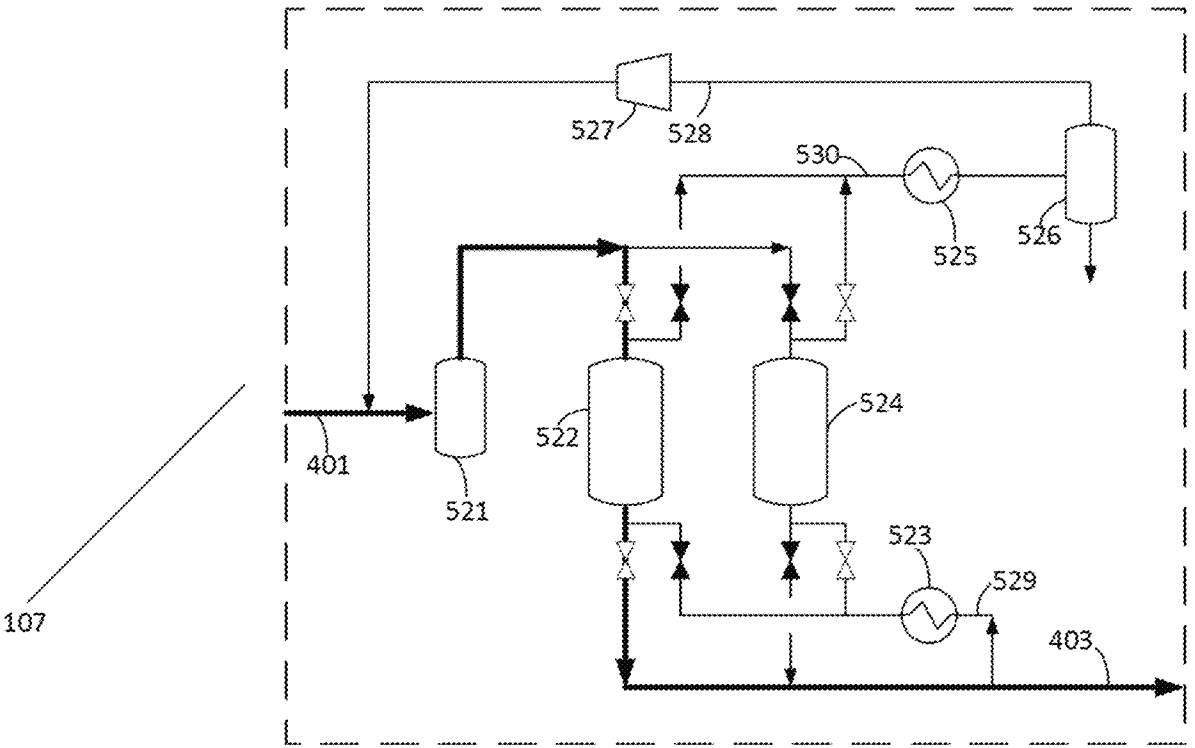
FIG. 5 is a schematic diagram showing an arrangement of duplicate gas dehydration offshore, usable in an embodiment of the method.

FIG. 5 shows details of the dehydration unit 107. When using this unit, the gas in the manifold 108 is withdrawn through a conduit 401, and introduced into the dehydration unit 107. Dehydrated gas from the dehydration unit is returned to the manifold 108*a* via a conduit 403.

Gas from the conduit 401 is mixed with internal recycle gas from a compressor 527, see below. Any free water in this mixed gas is removed in a free water knock-out tank 521. The gas is next directed to a tank containing a water adsorbent, preferably a zeolite where water is removed to a residual concentration of less than 0.1 ppm by volume. Two tanks 522, 524, containing water absorbent are arranged in parallel. One of the tanks 522, 524, at the time is used for drying of the gas, whereas the other tank 522, 524, is regenerated, as will be described below. After drying, the gas is returned to the manifold 108*a* via the conduit 403. A side draw of some of the dehydrated gas from the conduit 403 is taken in a conduit 529. This gas is heated to for example 300° C. in a heater 523, then piped to the tank 522, 524 that is not used for drying of the gas for re-generation of the adsorbent. The resulting humid gas is withdrawn through a conduit 530, and cooled in a cooler 525. Precipitated water is removed in a water knock-out tank 526 before the gas is compressed in the compressor 527 and re-cycled into the conduit 401, as described above.

Figure 6:
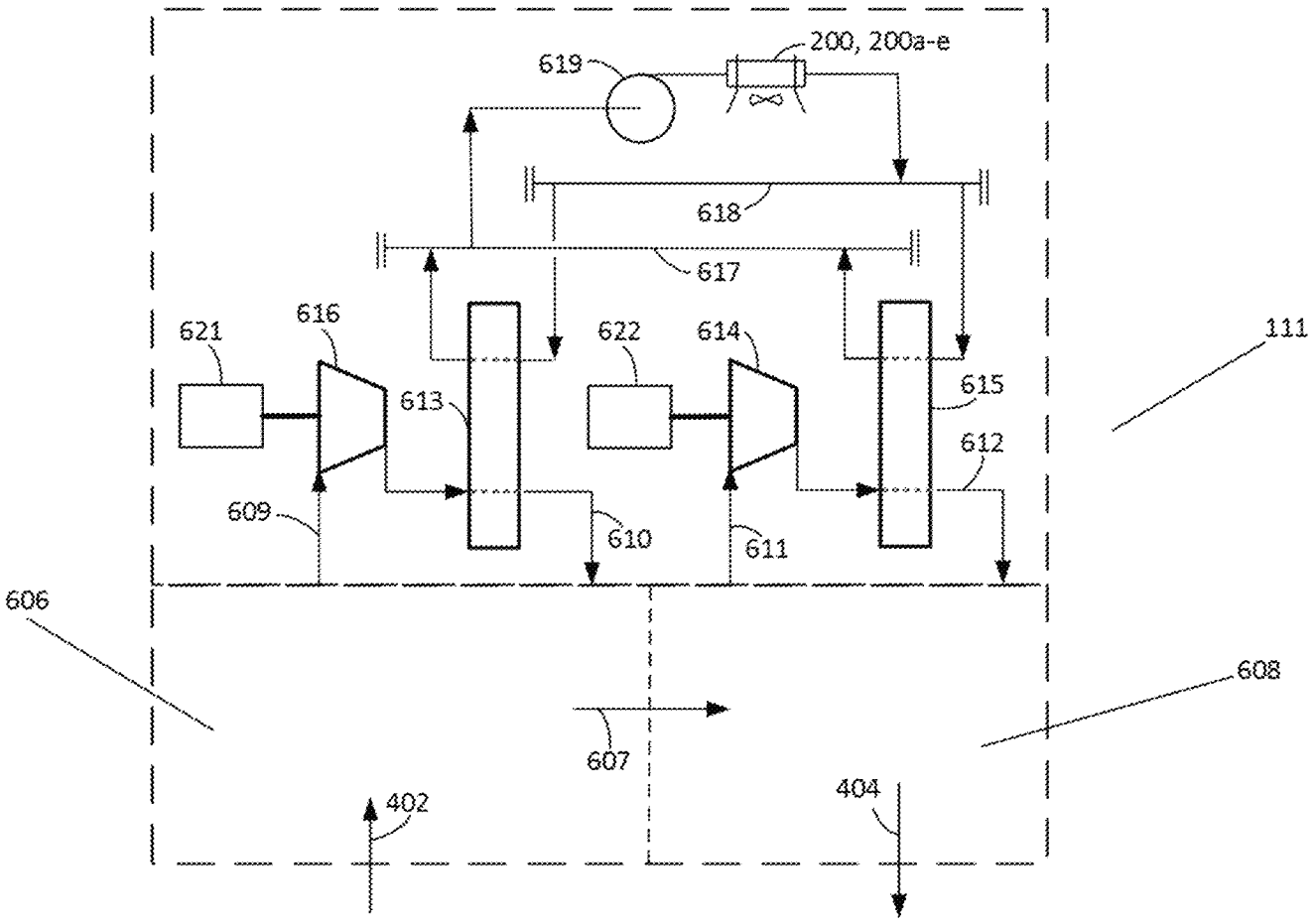
FIG. 6 is a schematic diagram of an arrangement of the offshore liquefaction process, showing gas cooling sections connected to direct drive compressor power supplies and with indirect air cooling, usable in an embodiment of the method.

FIG. 6 shows details of the compression and cooling plants 111, 111*a, b*. The liquefaction plants 111, 111*a, b* are identical, and are all described with reference to liquefaction plant 111 below. The liquefaction plant receives gas, about one third of the total gas flow, via a conduit 402. This gas is pre-cooled by counter-current heat exchange with a refrigerant in a pre-cooling system 606. The refrigerant is derived from the liquefaction gas and can be directly returned to the liquefaction gas should refrigerant system de-pressurization be required. This eliminates the need for separate refrigerant storage, enhancing the overall system safety. The refrigerant will comprise mainly methane.

The gas pre-cooling is powered by a compressor 616 with direct gas turbine drive 621. It receives low pressure, spent refrigerant from the pre-cooling system 606 via a conduit 609. After compression, the refrigerant is cooled in a heat exchanger 613 by counter-current heat exchange with water, ensuring that the water is heated to at least 80° C. for efficient downstream air cooler operation. The refrigerant is subsequently recycled to the pre-cooling system 606 via a conduit 610 for re-use. Persons skilled in the art will know that the compressor 616 may comprise one or several inter-cooled stages and one or more parallel units.

Following the pre-cooling, the liquefaction gas is piped to a final cooling system 608 via a conduit 607. The final cooling is accomplished by a pressure reduction that produces a liquid and a flash gas. The flash gas is compressed and re-cycled, while the liquid becomes the LNG product. If the pressure is close to atmospheric, the resulting LNG will be nearly stable at atmospheric pressure.

Flash gas from the final cooling system is piped to a compressor 614 via a conduit 611. The compressor is driven by a direct drive gas turbine 622. Persons skilled in the art will know that the compressor 614 may comprise one or several inter-cooled stages and one or more parallel units.

The compressed flash gas is cooled by counter-current heat exchange with water in a heat exchanger 615, ensuring that the water is heated to at least 80° C. for efficient downstream air cooler operation. The compressed gas is recycled to the liquefaction process, preferably upstream the gas pre-cooling, or upstream the pre-cooling system 606.

Adjustment of the temperature after gas pre-cooling, the stream 607, change the relative load on compressors 616 and 614 with drivers 621 and 622. This should preferably be done such that gas turbines 621 and 622, whether single or parallel units, are of the same size and type, all operating at full capacity.

Cooling water from heat exchangers 613 and 615 transports sensible heat to a manifold 617. A pump 619 takes water, now at 80° C. or warmer, from the manifold 617 and conveys the water to air coolers 200, 200*a-e*, where the water is cooled by heat exchange with ambient air. The cooled water then flows to a manifold 618, from which it is distributed to the heat exchangers 613 and 615, closing the cooling water loop. The final result is a fully air-cooled gas liquefaction process.

EXAMPLE

A process for the production of about 12.0 million tonnes LNG per year, assuming 335 days of operation per year, receives 1 785 tonnes per hour pipeline gas in the conduit 100. The gas pressure is 50 bara. The gas is at near ambient temperature, 20° C.

TABLE 1

Gas composition before and after pre-processing

| Component | Unit | Before pre-processing | After pre-processing |
|---|---|---|---|
| H2O | Mole % | 0.010 | 0.000 |
| | (ppmv) | | (<0.1) |
| Nitrogen | Mole % | 1.000 | 1.000 |
| CO2 | Mole % | 2.000 | 0.005 |
| | (ppmv) | | (<50) |
| H2S | Mole % | 0.001 | 0.000 |
| | (ppmv) | | (<2) |
| Methane | Mole % | 94.102 | 96.053 |
| Ethane | Mole % | 2.600 | 2.653 |
| Propane | Mole % | 0.200 | 0.204 |
| i-Butane | Mole % | 0.025 | 0.025 |
| n-Butane | Mole % | 0.035 | 0.035 |
| i-Pentane | Mole % | 0.009 | 0.009 |
| n-Pentane | Mole % | 0.006 | 0.006 |
| C6+ | Mole % | 0.012 | 0.010 |
| Total | Mole % | 100.00 | 100.00 |

The gas is pre-processed, removing 93 tonnes gas per hour in the form of $CO_2$, $H_2O$ and other unacceptable components. In addition, there is a 67 tonnes per hour side draw of pre-processed gas to be used as fuel gas, via the conduit 317. The remaining gas, 1625 tonnes per hour, is compressed to 127 bara and piped 160 km to the offshore pipeline end manifold in a 42" inner diameter pipeline. The arrival pressure is 105 bara and the pressure drop is about 22 bar. From the pipeline end manifold the gas is directed to the vessel turret 105 and associated swivel via 4 parallel, 16" inner diameter flexible pipes. The pressure drop in the pipeline end manifold, the flexible pipes and the turret 105 is about 1 bar. This pressure is further reduced to about 94 bara in the back-pressure control valve 416.

On the offshore vessel the gas may be dehydrated once more, if the hygrometer 400 indicates excess moisture in the gas. This dehydration is in addition to dehydration performed on shore. The amount of water removed may negligible from an overall mass balance point of view, but important for the reliable operation of downstream liquefaction plants.

Downstream of this dehydration there is a side draw of about 11 tonnes per hour fuel gas via the conduit 413. This gas is mixed with about 129 tonnes/hour compressed boil-off gas, conduit 411, to give the vessel fuel supply, the conduit 414. The remaining main gas flow, 1 614 tonnes per hour, is distributed evenly to 3 liquefaction plants 111 via gas manifold 108*a*.

In each of the 3 liquefaction plants, the pressure is controlled at about 94 bara and the flow, 1614/3 or 538 tonnes per hour, is pre-cooled by heat exchange with natural gas or mainly methane refrigerant in the plant 606. The refrigerant inventory is taken from the liquefaction gas itself and there is no need for external refrigerant supply or refrigerant storage.

After this initial cooling the gas is piped to the final cooling in the process 608. Cooling occurs by pressure reduction and compression and recycle of the resulting gas. The liquid becomes the LNG product. The LNG is piped, to storage tanks 116 where a final flash takes place, stabilizing the LNG and producing fuel gas.

The flash or boil-off gas from the tanks 116 is caused by flashing of non-stabilized LNG feed to the tanks, by heat ingress into the tanks and by gas displacement as the tanks are filled with LNG. The total amount is about 129 tonnes per hour, which together with 11 tonnes per hour side-draw from the feed gas covers the fuel requirement of about 140 tonnes per hour.

The total amount of LNG offloaded is 1485 tonnes per hour, or about 12.0 million tonnes annually assuming 335 days of operation. For each of the liquefaction plant 111 the total compression duty, including pre-cooling and flash gas recycle, is about 180 MW, compressors 614 and 616. Together with heat removed from the gas in order to produce LNG, the total process cooling requirement becomes about 300 MW, coolers 613, 615. This heat is removed from the process by cooling with water, heating the cooling water to about 95° C. This water is in turn pumped to the air coolers 200, 200*a* via the pump 619 and thus cooled by heat exchange with ambient air. An air temperature of 25° C. gives overall specific heat of liquefaction about 0.36 kWh/kg LNG.

The invention claimed is:

1. A method for large-scale, air cooled floating liquefaction, storage and offloading of natural gas, the method comprising:

a) gathering gas from onshore sources and treating the gas on shore by removal of mercury, removal of acid gas, dehydration and removal of C6+ hydrocarbons, b) onshore compressing and cooling of the treated gas of step a);

c) piping of the compressed gas of step b) from onshore to an offshore pipeline end manifold;

d) piping of the gas of step c) from the pipeline end manifold to an offshore ship-shaped, external-turret-moored vessel;

e) receiving the gas of step d) on the vessel via a swivel mounted on a turret;

f) distributing the gas of step e) to three parallel liquefaction trains on the vessel;

g) liquefying the gas of step f) by methane refrigerant and subsequent flash;

h) cooling the gas of step g) from compressors by heat exchange with cooling water;

i) heating the cooling water of step h) to 80° C. or higher via downstream process heat exchangers;

j) cooling the cooling water of step i) by heat exchange with air in air coolers mounted on at least three mechanically independent cantilevers, in total extending at least 50% of the vessel length;

k) recycling the cooled cooling water to process heat exchangers;

l) providing gas turbine air intakes for liquefaction and utilities located on the opposite side of the at least three mechanically independent air cooler cantilevers;

m) sending liquid natural gas ("LNG") that is not completely stabilized to storage tanks;

n) storing produced LNG in multiple smaller membrane tanks onboard the vessel;

o) flashing LNG in the storage tanks; and p) offloading gas to LNG tank vessels while the liquefaction processes are in full production.

2. The method according to claim 1, wherein the gas offloading of step p) is performed via offloading arms located on the side of the ship-shaped, external turret-moored vessel being opposite of the cantilever air coolers.

3. The method according to claim 1, wherein the gas offloading of step p) is performed via parallel offloading.

4. The method of claim 1, wherein the gathering of step a) is from onshore pipeline networks.

5. The method of claim 1, wherein flash gas from the storage tanks is used as fuel gas onboard the vessel.

6. The method of claim 1, wherein water content in the gas received at step e) onboard the vessel is monitored and the incoming gas is dehydrated before introduction into step f) if the water content of the gas is above a preset level.

7. The method of claim 1, wherein the steps are performed in the order listed.

* * * * *